US007009569B2

(12) United States Patent
Lipka et al.

(10) Patent No.: US 7,009,569 B2
(45) Date of Patent: Mar. 7, 2006

(54) VENT-MOUNTABLE MOTOR-VEHICLE ANTENNA

(75) Inventors: Günter Lipka, Deizisau (DE); Alexander Gelman, Fellbach (DE); Jürgen Heuser, Neckartailfingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/814,817

(22) Filed: Mar. 31, 2004

(65) Prior Publication Data

US 2004/0212539 A1 Oct. 28, 2004

(30) Foreign Application Priority Data

Apr. 4, 2003 (DE) ..... 103 15 641

(51) Int. Cl.
*H01Q 1/32* (2006.01)

(52) U.S. Cl. ..... 343/711; 343/713

(58) Field of Classification Search ..... 343/700 MS, 343/702, 711, 713, 846
See application file for complete search history.

(56) References Cited

U.S. PATENT DOCUMENTS

| | | | | |
|---|---|---|---|---|
| 4,516,127 | A | 5/1985 | Siwiak | 343/702 |
| 6,054,955 | A | 4/2000 | Schlegel et al. | 343/702 |
| 6,686,888 | B1 | 2/2004 | Wendt et al. | 343/713 |
| 2003/0034932 | A1 | 2/2003 | Huebner et al. | 343/795 |
| 2003/0201939 | A1 * | 10/2003 | Reece et al. | 343/700 MS |

FOREIGN PATENT DOCUMENTS

| | | |
|---|---|---|
| DE | 199 62 736 | 7/2001 |
| EP | 1 206 005 A1 | 5/2002 |
| EP | 1 306 924 A2 | 5/2003 |

OTHER PUBLICATIONS

Patent Abstract of Japan; Pub. No. 08186420; Appl. No. 06329066; Applicant: Zanavy informatics; Print Antenna.

* cited by examiner

*Primary Examiner*—Hoang V. Nguyen
(74) *Attorney, Agent, or Firm*—Herbert Dubno; Andrew Wilford

(57) ABSTRACT

A motor-vehicle antenna has a monopole formed by a rigid circuit-board having a conductive trace, a socket for connecting a coaxial cable to the monopole, and a ground plane formed of rigid sheet metal or a circuit board and fixed to the monopole.

14 Claims, 8 Drawing Sheets

VENT-MOUNTABLE MOTOR-VEHICLE ANTENNA

FIELD OF THE INVENTION

The present invention relates to an antenna. More particularly this invention concerns a high-frequency antenna that can be mounted in a vent of a motor vehicle in particular for use by a mobile radio set or telephone.

BACKGROUND OF THE INVENTION

U.S. Pat. No. 6,686,888 describes a high-frequency antenna for use with a mobile radio that is mounted in the vent grill. The antenna comprises a monopole and ground plane (or balancing antennas) all formed as conductive traces on flat T-shaped printed-circuit board. The board is fitted to the plastic vent grille and acts as a so-called slit antenna, particularly usable in the 2.4 GHz range. The ground plane extends at a right angle to the monopole, and there may be in fact two ground planes.

OBJECTS OF THE INVENTION

It is an object of the present invention to provide an improved antenna.

Another object is the provision of such an improved antenna which is of simpler and more durable construction than the prior-art devices.

SUMMARY OF THE INVENTION

A motor-vehicle antenna has according to the invention a monopole formed by a rigid circuit-board having a conductive trace, a socket for connecting a coaxial cable to the monopole, and a ground plane formed of rigid sheet metal or a circuit board and fixed to the monopole.

When the ground plane or balancing antenna is formed of sheet metal, the antenna is very rugged and it has fewer parts than the prior-art such antennas. As a result such an antenna can be made very inexpensively. A sheet-metal ground plane can be made simply by stamping.

When the ground plane or balancing antenna is formed of a printed-circuit board, the resultant structure is still quite durable and fairly light. The use of a printed-circuit board makes it easy to mount the antenna in a motor vehicle without having to provide insulated supports engaged between the ground plane and the grounded vehicle body, as the connection can be made to the phenolic board of the printed circuit in a location where it has not conductive traces. A printed-circuit ground plane can be provided with clips or fasteners allowing it to be screwed or riveted in place in, for example, a motor-vehicle vent.

According to a further feature of the invention, the monopole and the ground plane are permanently bonded together, typically by soldering. This produces a very solid mechanical connection that conducts electricity well. Of course, instead of solder it would be possible to use a strong conductive adhesive for the bonding.

The ground plane in accordance with the invention, in particular when of sheet metal, is formed with an edge flange to which the monopole is fixed. This flange is formed with a groove or seat into which the circuit board of the monopole fits for a strong connection. The flange is central so the resultant structure has the standard T-shape of a monopole with a pair of ground planes. Thus the ground plane and monopole are both substantially planar and extend generally perpendicular to each other. Such a structure can easily be integrated into the grill of a motor-vehicle vent so it is safe but virtually invisible.

The socket includes jaws crimpable to the coaxial cable. Hence the cable can be solidly connected to the antenna by a standard cable crimper.

The socket according to the invention is fixed to the monopole or to the ground plane. When the ground plane is made of sheet metal, the socket can even be unitarily formed with the ground plane. If not unitary, the socket can have tabs set in the monopole or ground plane so the cable connection is very strong.

According to a further feature of the invention, a splitter is provided having a pair of sockets connectable via respective coaxial cables to two such monopoles and another socket connectable to a receiver or transmitter, so that this splitter can be used to feed a signal from a transmitter to two antennas, or can combine the signals from two antennas on opposite sides of the vehicle and feed them to a receiver. Either way the splitter has a housing holding the printed-circuit board of the splitter, and in which the board can actually be potted, along with inner ends of the sockets. Such a splitter can be mounted anywhere in the vehicle.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
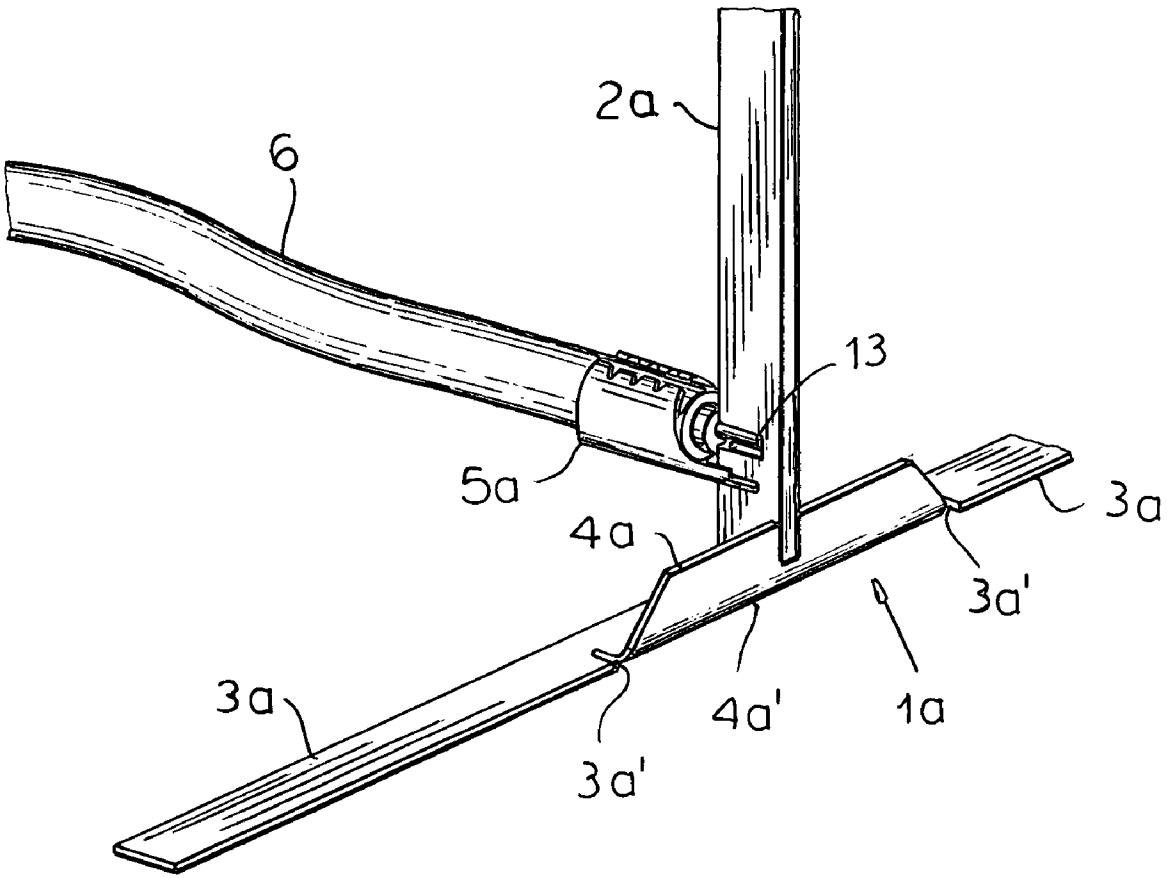
FIGS. 1 and 2 are perspective views of an antenna according to the invention.
Figure 2:
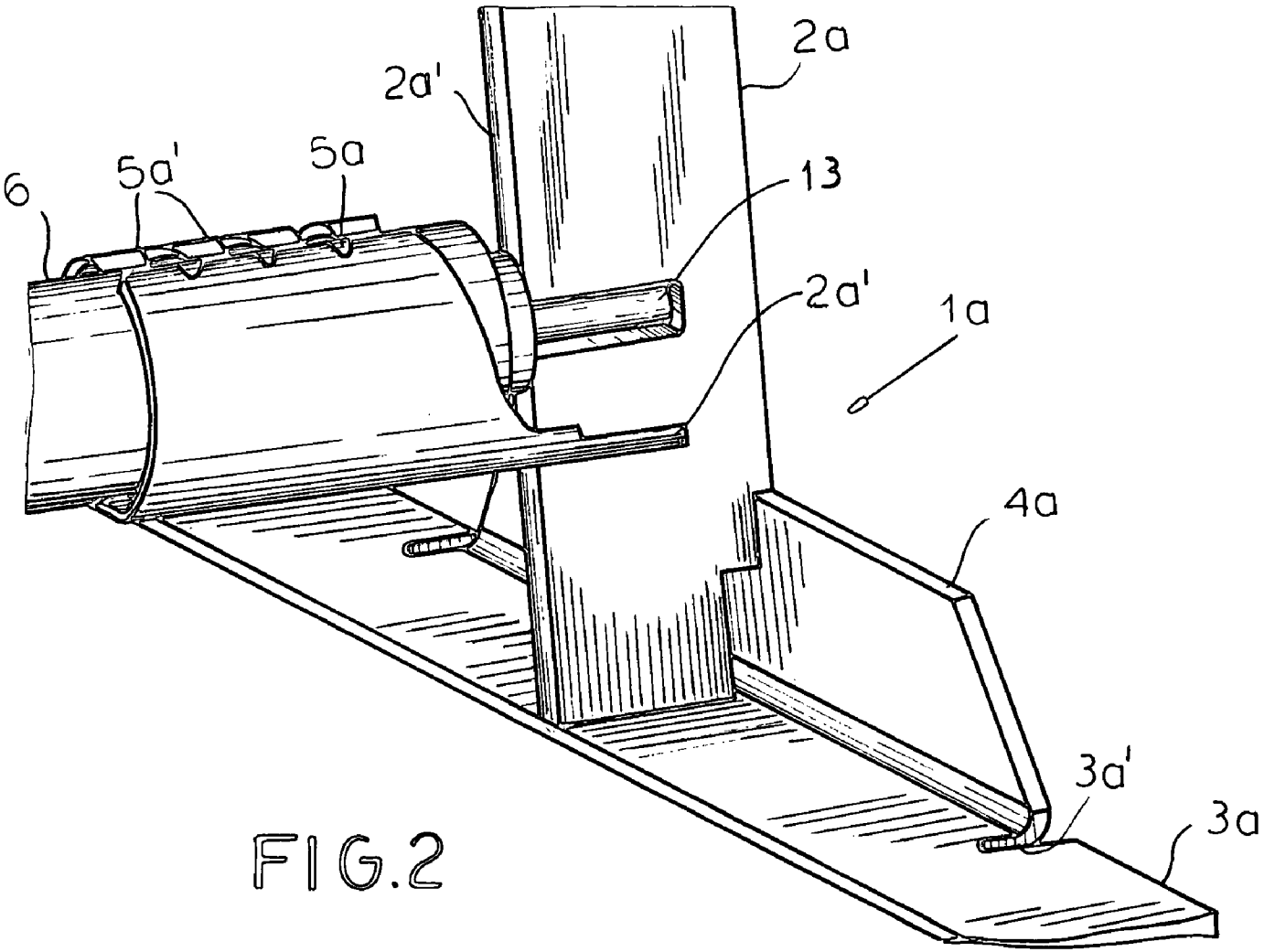

As seen in FIGS. 1 and 2, an antenna 1*a* according to the invention is basically comprised of a monopole 2*a* formed as a conductive trace on a nonconductive printed-circuit board and a sheet-metal double ground plane 3*a* comprised of a strip of sheet metal lying in a plane extending orthogonally to the plane of the monopole 2*a* and forming therewith a T-shape. The sheet-metal ground planes 1 are formed centrally with a perpendicular edge flange 4*a* delimited by slots 3*a*' and having its own central slot 4*a*' in which the monopole 2*a* is fitted. A socket sleeve 5*a* grips a coaxial cable 6 having a central conductor 13 connected by bonding or solder to the monopole trace and set in a groove 2*a*' of the monopole 2. The sleeve 5*a* is formed as a pair of claws having teeth 5*a*' that dig into the insulation of the cable 6 and lock it physically very solidly to the antenna 1*a*, and a tab 5*a*" of the sleeve 5*a* is fitted in a slot 2*a*' in the monopole 2*a*. Another bond can be provided at the slot 4*a*' holding the monopole 2*a* in place.

Figure 3:
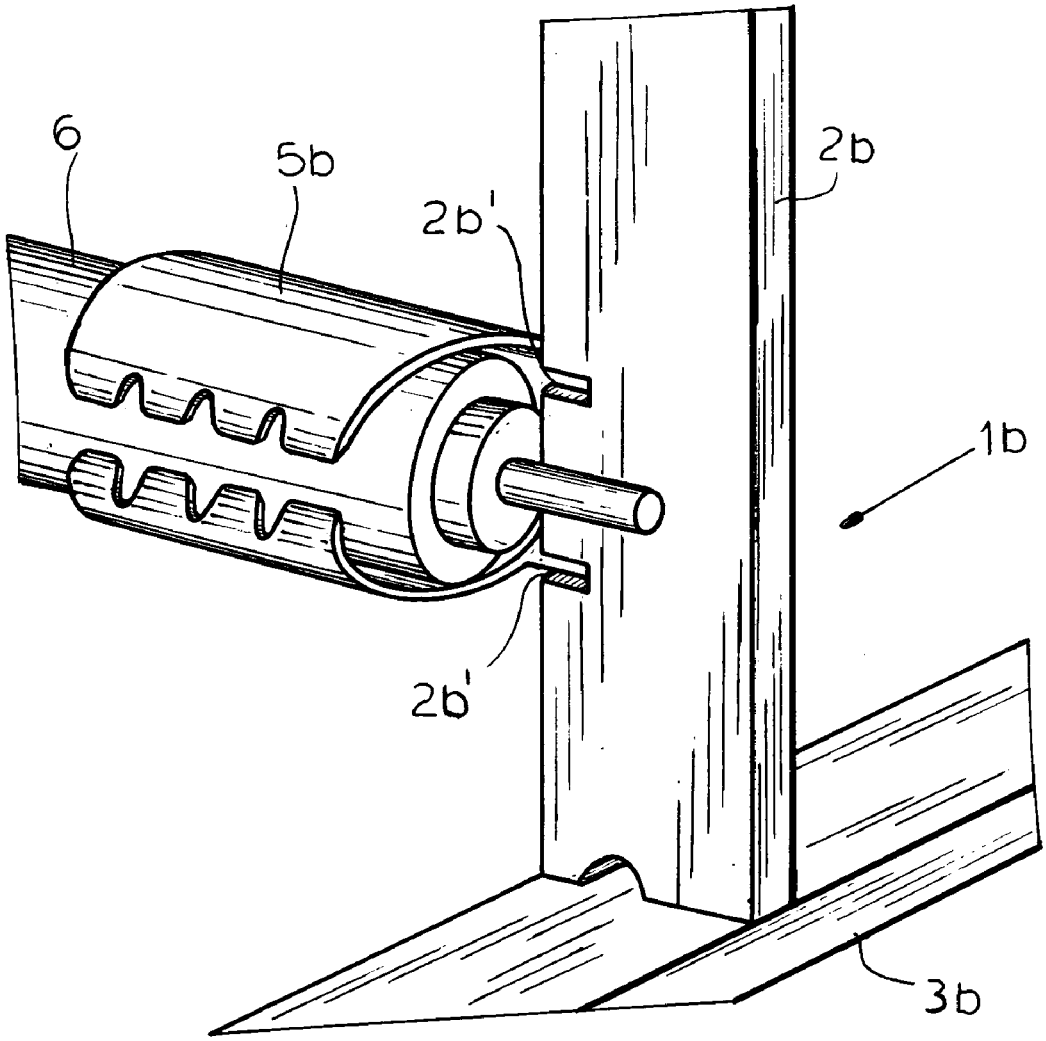
FIGS. 3 and 4 are perspective views of a second antenna in accordance with the invention.
Figure 4:
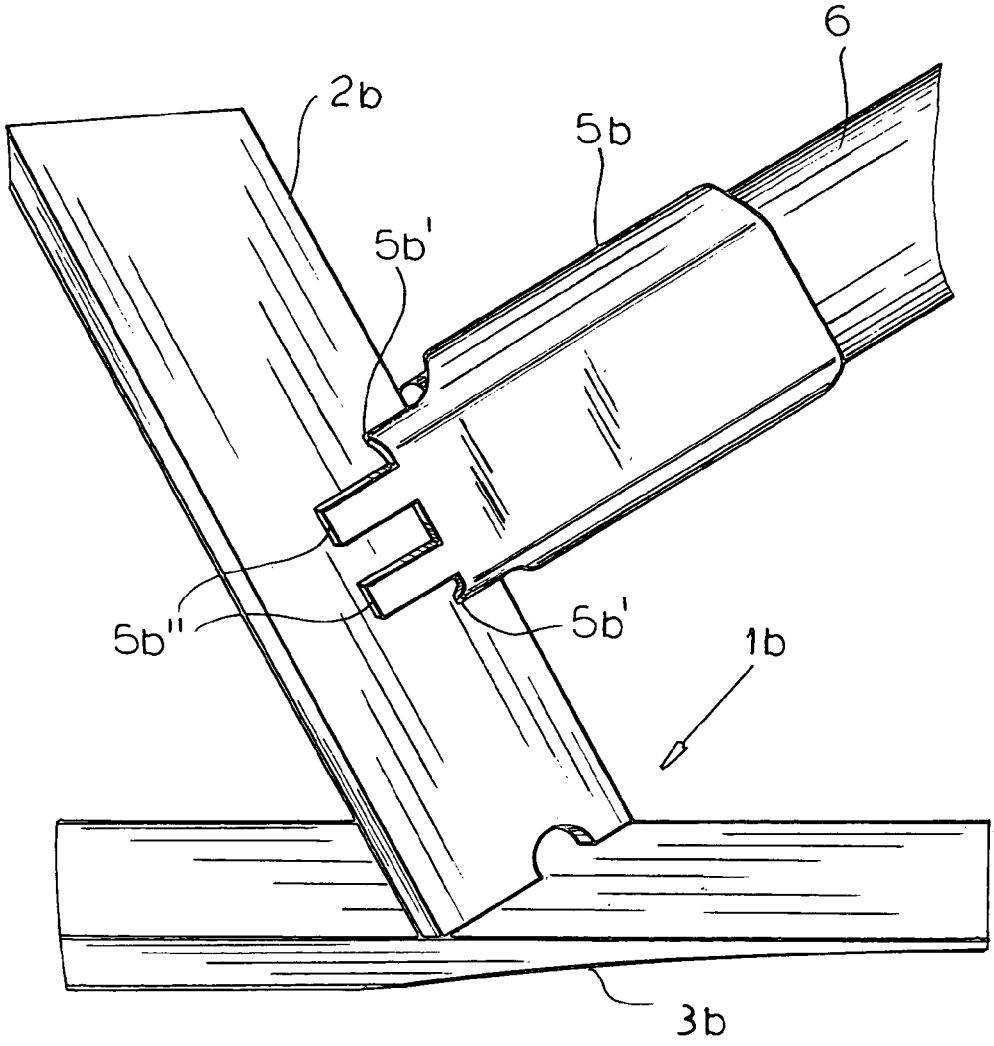

FIGS. 3 and 4 show an antenna 1*b* like the antenna 1*a*, but with functionally identical parts carrying a postscript "b"

instead of "a." Here the printed-circuit monopole 2*b* is formed with a pair of notches 2*b*' into which tabs 5*b*' of the socket 5*b* are fitted. In addition two other tabs 5*b*" of the socket 5*b* engage flatly with the monopole 2*b* and may electrically connect the braid shielding of the cable 6 to a trace on the back of the monopole 2*b*. The ground plane 3*b* here is formed as a printed-circuit board, like the monopole 2*a*, and the monopole 2*a* extends at an acute angle to the ground plane 3*b*.

Figure 5:
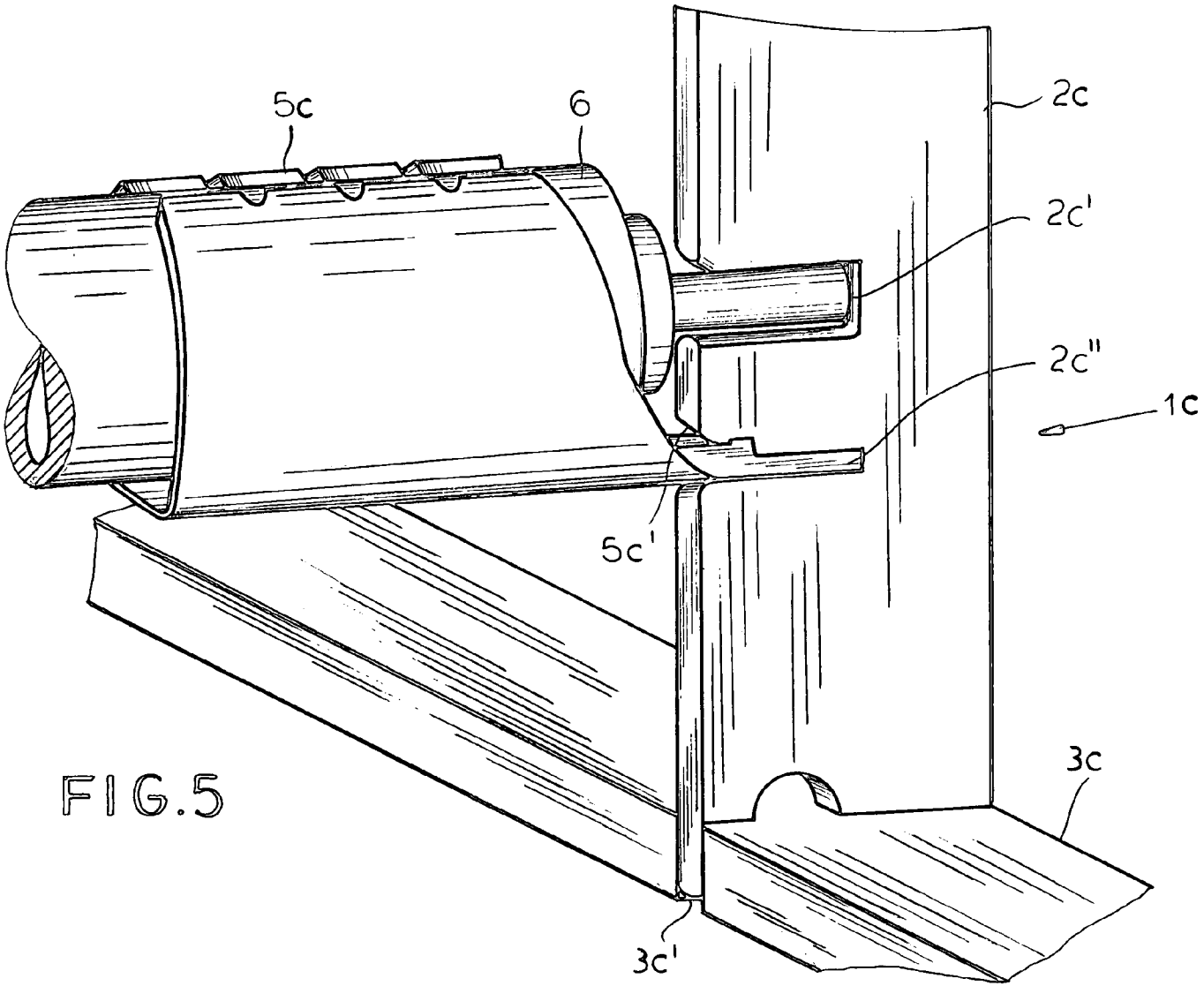
FIG. 5 is a perspective view of a third antenna.

The antenna 1*c* of FIG. 5 is like that of FIGS. 3 and 4, except that the monopole 2*c* is perpendicular to the printed-circuit ground plane 3*c* and is set in grooves 3*c*' thereof. In addition the edge of the monopole 2*c* is formed with a notch 2*c*' for the conductor 13 and another notch 2*c*" for the single tab 5*c*' of the socket 5*c*.

Figure 6:
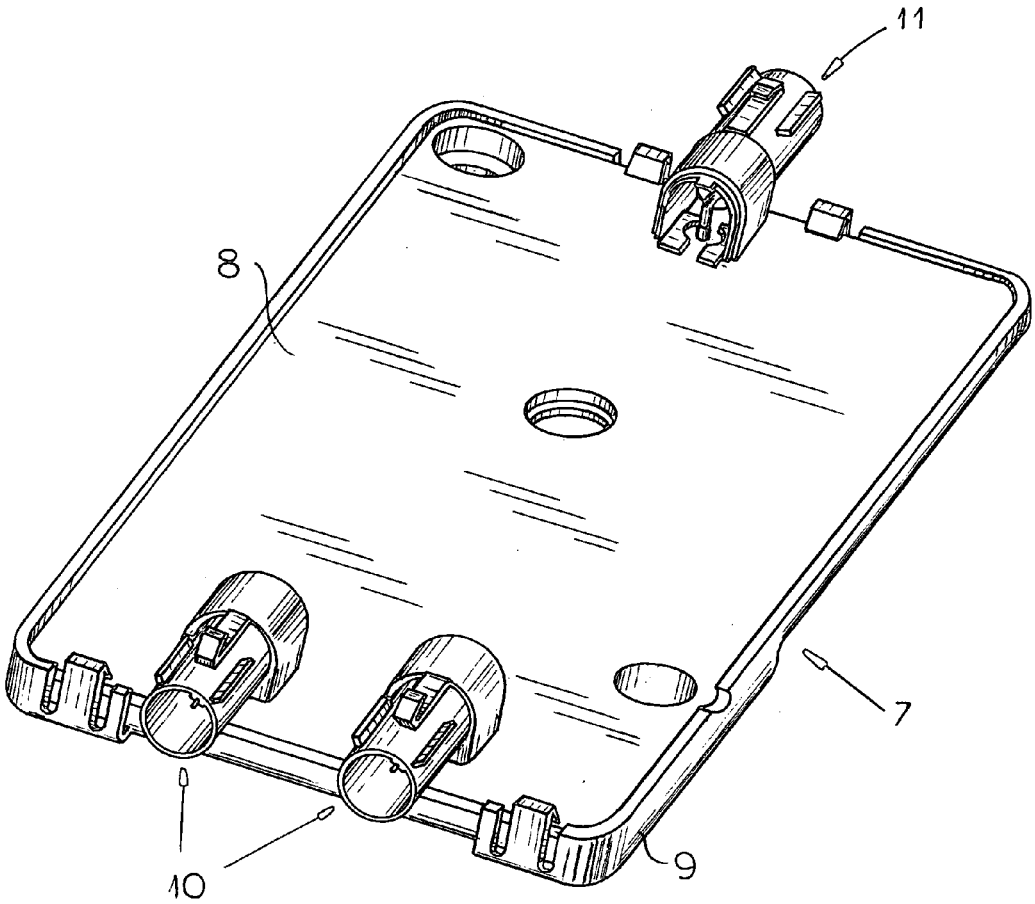
FIG. 6 is a perspective view of a summing connector for the antennas of this invention.

FIG. 6 shows a summing point or splitter 7 for connecting two antennas to a single receiver and/or transmitter. It has a printed-circuit board 8 carrying on its unillustrated underside electronic and circuit elements for connecting two input/output sockets 10 with a single output/input socket 11. The board 8 is surrounded by a housing 9 and is normally closed over the sockets 10 and 11 by a cover with a gasket. The board 8 is fixed by snaps or the like to the housing 9 and the conductors and braid shields of cables plugged into the sockets 10 and 11 are connected by soldering or some other conductive bond to the elements and traces of the board 8. This device can be used to feed a signal from a transmitter to two antennas, or to feed the signal from two antennas to a single receiver. The sockets 10 and 11 can in fact be imbedded in the board 8 and can be of different construction, for example male externally threaded. Such a splitter can be mounted out of the way in the vehicle and does not need to be close to either the transmitter/receiver or the antennas.

Figure 7:
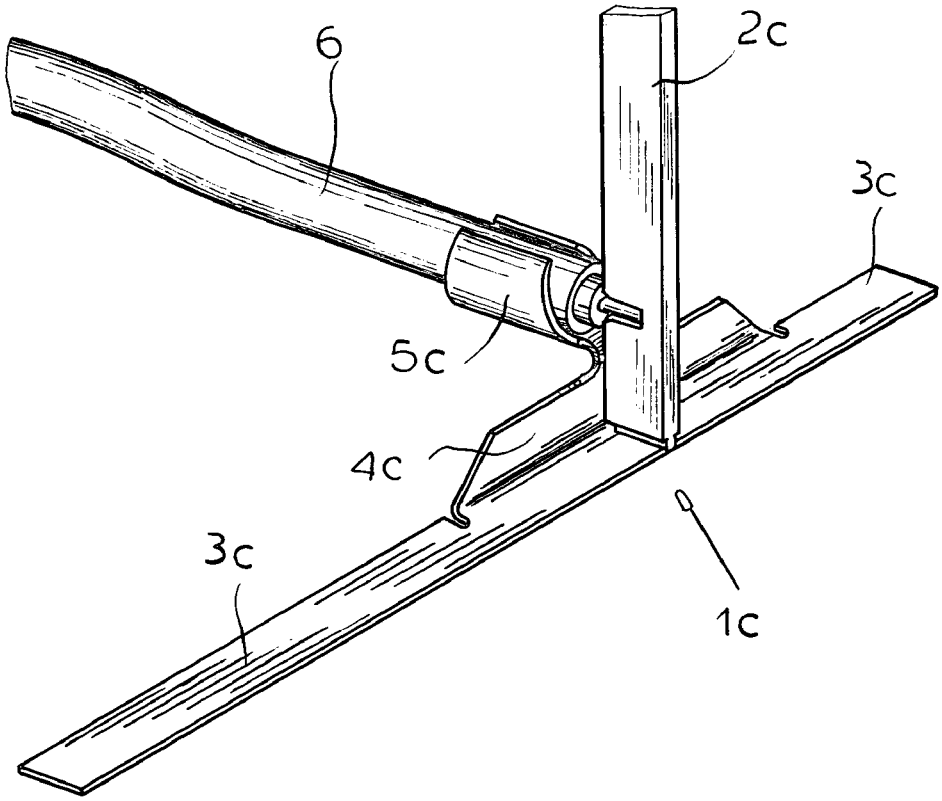
FIGS. 7 and 8 are perspective views of a further antenna in accordance with the invention.
Figure 8:
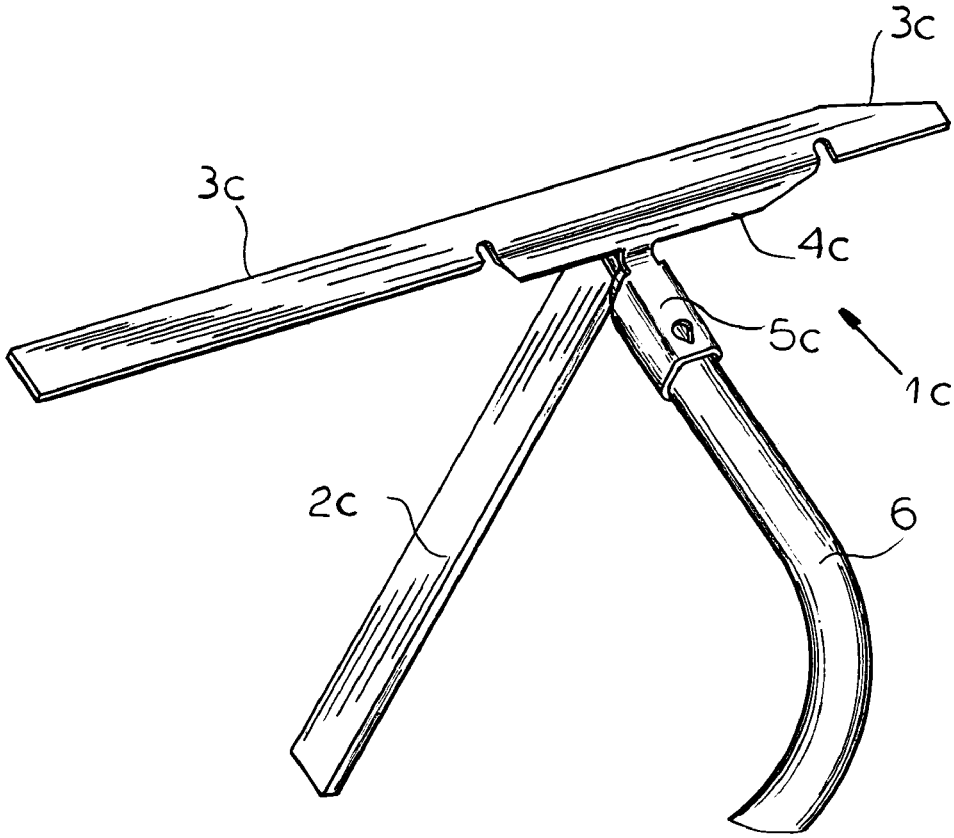

FIGS. 7 and 8 show an antenna 12*c* formed much like the antenna 1*a* of FIGS. 1 and 2, that is having a printed-circuit monopole 2*c* set on a sheet-metal double balancing antenna or ground plane 3*c* having a flange 4*c*. Here, however, the socket or sleeve 5*c* for the coax feed line 6 is formed unitarily with the flange 4*c*. Hence the cable 6 is very solidly mounted to this one-piece part forming the two ground planes 3*c* and the flange 4*c*, producing a very rugged assembly.

We claim:

1. A motor-vehicle antenna comprising:

a monopole formed by a rigid circuit-board having a conductive trace;

means including a socket for connecting a coaxial cable to the monopole; and a ground plane formed of rigid sheet metal or a circuit board, formed with an edge flange, and fixed to the monopole.

2. The motor-vehicle antenna defined in claim 1 wherein the monopole and the ground plane are permanently bonded together.

3. The motor-vehicle antenna defined in claim 1 wherein the monopole is fixed to the edge flange.

4. The motor-vehicle antenna defined in claim 1 wherein both the ground plane and monopole are substantially planar and extend generally perpendicular to each other.

5. A motor-vehicle antenna comprising:

a monopole formed by a rigid circuit-board having a conductive trace;

means including a socket having jaws crimpable to the coaxial cable for connecting a coaxial cable to the monopole; and a ground plane formed of rigid sheet metal or a circuit board and fixed to the monopole.

6. The motor-vehicle antenna defined in claim 5 wherein the socket is fixed to the monopole or to the ground plane.

7. The motor-vehicle antenna defined in claim 5 wherein the ground plane is made of sheet metal and the socket is unitarily formed with the ground plane.

8. A motor-vehicle antenna comprising:

a monopole formed by a rigid circuit-board having a conductive trace;

means including a socket for connecting a coaxial cable to the monopole;

a ground plane formed of rigid sheet metal or a circuit board and fixed to the monopole; and a splitter having a pair of inputs connectable via respective coaxial cables to two such monopoles and an output connectable to a receiver.

9. A motor-vehicle antenna comprising:

a monopole formed by a rigid circuit-board having a conductive trace;

means including a socket for connecting a coaxial cable to the monopole;

a ground plane formed of rigid sheet metal or a circuit board and fixed to the monopole; and a splitter having a pair of outputs connectable via respective coaxial cables to two such monopoles and an input connectable to a transmitter.

10. A motor-vehicle antenna comprising:

a monopole formed by a rigid circuit-board having a conductive trace;

means including a socket for connecting a coaxial cable to the monopole;

a ground plane formed of rigid sheet metal or a circuit board and fixed to the monopole; and a splitter having a printed-circuit board and two sockets connectable via respective coaxial cables to two such monopoles and another socket connectable to transmitter or receiver.

11. The motor-vehicle antenna defined in claim 10 wherein the splitter further comprises a housing holding the printed-circuit board of the splitter.

12. A motor-vehicle antenna comprising:

a monopole formed by a rigid circuit-board having a conductive trace;

means including a socket for connecting a coaxial cable to the monopole; and a ground plane formed of rigid sheet metal, having an edge flange fixed to the monopole, and extending generally perpendicular to the monopole.

13. The motor-vehicle antenna defined in claim 12 wherein the flange is formed with a slot into which the board is set.

14. The motor-vehicle antenna defined in claim 12 wherein the flange is unitarily formed with the socket.

* * * * *